United States Patent [19]

Brabander

[11] 4,258,905

[45] Mar. 31, 1981

[54] POST-STAKE DRIVER

[76] Inventor: Joseph Brabander, Rte. 1, Box 33, Deer Creek, Okla. 74636

[21] Appl. No.: 93,144

[22] Filed: Nov. 9, 1979

[51] Int. Cl.[3] ..... E21B 19/00

[52] U.S. Cl. ..... 254/29 R

[58] Field of Search ..... 254/29 R, 124

[56] References Cited

U.S. PATENT DOCUMENTS

| | | | |
|---|---|---|---|
| 2,551,896 | 5/1951 | Notestein | 254/29 R |
| 2,617,627 | 11/1952 | Evonuk et al. | 254/29 R |
| 2,634,092 | 4/1953 | Lindquist | 254/29 R |
| 2,657,010 | 10/1953 | Sabin et al. | 254/29 R |

*Primary Examiner*—Robert C. Watson

*Attorney, Agent, or Firm*—Jack N. Shears

[57] ABSTRACT

The internal hydraulics of a three-point mount system of a tractor are utilized to drive stakes or posts. A base is rigidly mounted on the tractor chassis and rigidly braced to the stationary point of the three point. A frame having an upright member is rigidly mounted on the base and has a holding assembly with a latch or anvil for holding and urging a post or stake downwardly. The lever arms of the movable two points of the three point connect via pivot points, push levers, pivot points, pivot arms, and pivot points to the movable assembly such that upward movement of the two points effect levering of the assembly downward. The pivot arms are connected via centerized pivot points, and holding arms to the base.

6 Claims, 5 Drawing Figures

POST-STAKE DRIVER

BACKGROUND OF THE INVENTION

The invention relates to apparatus for driving upright members such as posts or stakes into the ground.

BRIEF DESCRIPTION OF THE PRIOR ART

The following, inter alia, is intended to be a prior art statement in accord with the guidance and requirements of 37 CFR 1.5, 1.97, and 1.98.

A series of patents are exemplary of prior art which show post or stake driving apparatus wherein a hydraulic cylinder is mounted on a frame and attached to an anvil or latch means which abuts or grips a post or stake such that an expansion stroke of the cylinder drives the post or stake into the earth. Representative patents include U.S. Pat. No. 3,129,924, U.S. Pat. No. 3,073,571, U.S. Pat. No. 2,742,258, U.S. Pat. No. 2,681,789 and U.S. Pat. No. 2,851,248. Of these, U.S. Pat. No. 3,129,924 is probably the most nearly related to the instant invention. However it differs in a number of ways which are apparent on comparison.

U.S. Pat. No. 2,662,729 discloses a post puller which utilizes a tractor three point hitch and hydraulic system. However, its difference from the instant invention is quite apparent upon comparison.

U.S. Pat. No. 2,551,897 is representative of yet another type of prior art hydraulic post driver. In that type system the contraction stroke of a hydraulic cylinder mounted in a frame urges a post downward by means of a latch onto the post.

It should be noted that the above cited prior art systems all require use of an external hydraulic cylinder. This leads to considerable additional expense and complication in that the cylinder, connecting hose, and, in many cases, a a separate hydraulic pump must be provided. None of these systems for post driving utilizes the internal hydraulic lift of the three-point system integral with virtually all modern farm tractors.

It is true that the internal hydraulic lift of a three point system is utilized according to U.S. Pat. No. 2,662,729, but the utilization is for post pulling, not driving. There is a compelling reason for this development of the art. The hydraulic lift of the three point system on many of such systems, powers only upward, not downward. Thus, a latch or anvil in combination with a frame, as might be suggested by the art represented by U.S. Pat. No. 3,129,924, is not useful for driving, as the system powers in the wrong direction.

The apparatus of the instant invention overcomes these difficulties in a novel and unobvious manner. It provides means for driving posts or stakes utilizing the internal hydraulic lift of a conventional three point system. A new, unobvious, and very advantageous result is thus obtained.

A searcher who conducted a pre-examination search relating to this application also cited a number of other references. However, none of these references appear to be more closely related than the references particularly discussed above. No representations are made into thoroughness or exhaustiveness of the pre-examination search which was conducted.

OBJECT OF THE INVENTION

An object of the invention is to provide apparatus for driving upright members such as posts and stakes utilizing the internal hydraulics and three point system of a conventional tractor.

SUMMARY OF THE INVENTION

Uprights such as posts or stakes are driven with an apparatus which is operable in combination with a tractor equipped with a three point hitch system which comprises:

(a) a base rigidly mountable on the rear of the tractor chassis and rigidly braceable to the stationary point of the three point hitch system, (b) rigidly mounted upright on the base, a frame having an upright member, (c) a holding assembly having an urging means for urging the upright downward and a tracking member for tracking along the upright member movably mounted on the upright member, (d) a pivot arm on each side of the holding assembly pivotly connected on one end thereto and on the other end to one end of a push lever, (e) the opposite end of each push lever pivotly connectable to the outer ends of the lift lever arm of the three point hitch system, (f) at a point along the length of each pivot arm a pivot connection connecting one end of a holding arm, and (g) the other end of each holding arm pivotly connected to the base, such that upward movement of the lift lever arms urges the push levers upward, in turn urging the connecting ends of the pivot arms upward, pivoting at the pivot connections of the holding arms, thus urging the other ends of the pivot arms downward along with the holding assembly and urging means along the upright member, while the holding arms pivot outward on the pivot connections to the base.

DESCRIPTION OF THE DRAWING AND A PREFERRED MODE OF THE INVENTION

The following exemplification and description relating to a presently preferred mode are provided in order to more fully explain the invention and to provide information to those skilled in the art on how to carry it out. However, it is to be understood that such is not to function as limitation on the invention as described and claimed in the entirety of this application.

Figure 2:
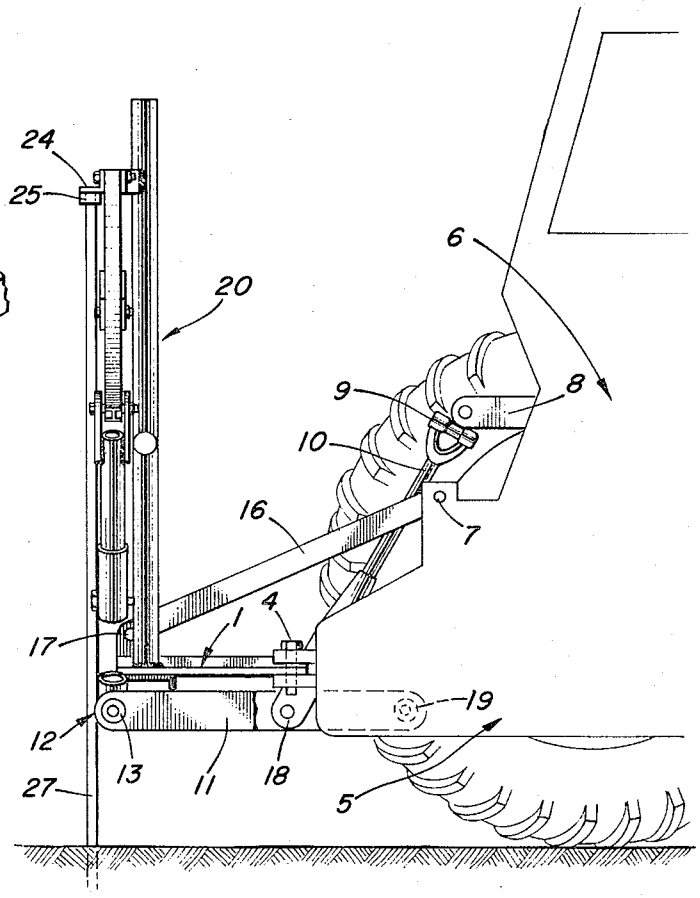
FIG. 2 shows a side view of the apparatus in relation to a three-point system equipped tractor.
Figure 1:
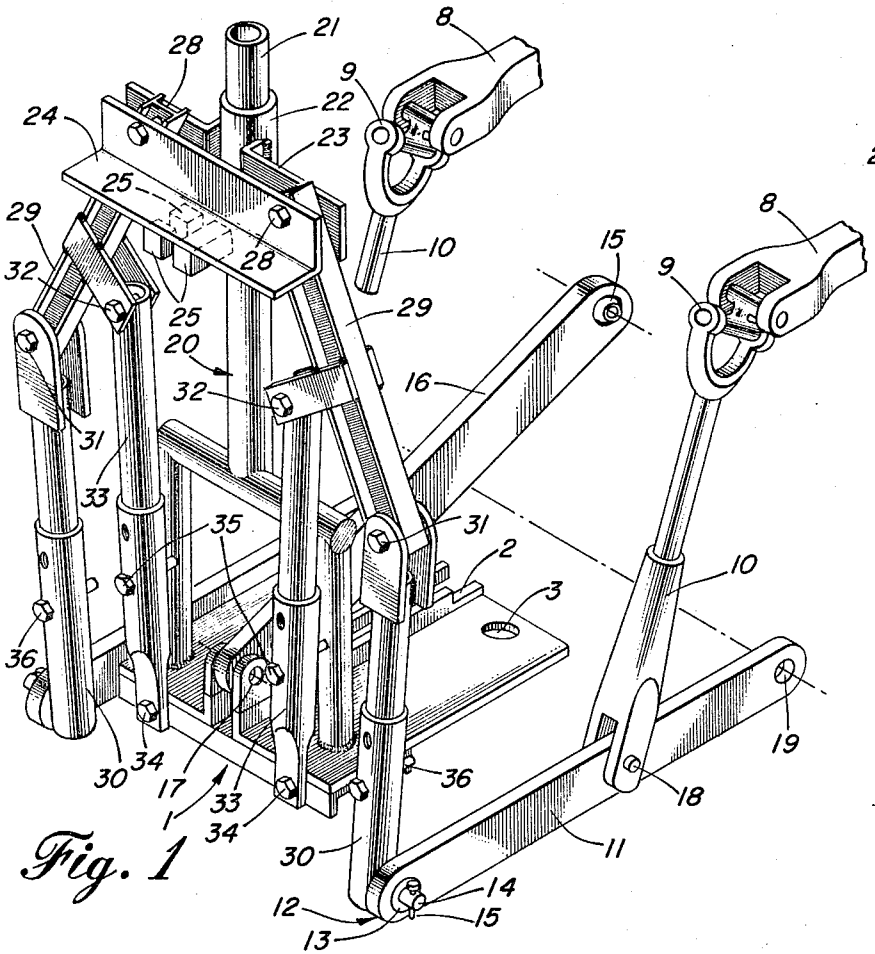
FIG. 1 shows a perspective of the post-stake driving apparatus of the invention in relation to the pivoting two point lever arms of a conventional three-point system of a farm tractor.

Referring to FIG. 1, a perspective of the post and/or stake driving apparatus of the invention, as it relates to selected parts of a conventional three-point hitch system, various parts and functions are described. The numbering and function also apply to the other figures as appropriate. Some of the Figures illustrate one part or function, while other Figures better illustrate others.

Base 1 of the apparatus is adapted by way of slot 2 and latch hole 3 to be rigidly fixed by latch pin 4 to chassis 5 of tractor 6. Tractor 6 conventionally is equipped with a three point hitch system which comprises a stationary pivot point 7, lifting arm 8 connected to internal hydraulics of the tractor such that upward powering is accomplished on manipulation of controls, universal connectors 9, connecting arms 10, and lever arms 11. The two point connections 12 on the outer end of the lever arms 11 are equiped with semi-hemisphere connectors 13 for insertion of connecting pins 14 of equipment to be attached and detached. Holding pins 15 prevent slippage of the connecting pins 14 from the connectors 13.

In conventional practice, equipment is mounted on the stationary point 7 by means of a semi-hemisphere connector 15 a connecting pin (not shown), a stand-off arm 16, and pivoting connector 17. The equipment is raised by powering up lifting arms 8 by the internal hydraulic system of the tractor. The lifting arms in turn lift lever arm 11 via universal connectors 9, connections 18 pivoting against connections 19 to lift the two point connection 12.

More particularly addressing the embodiment of the invention shown, base 1 is rigidly mounted on the fixed hitch of the tractor chassis 5 by way of slots 2, latch hole 3, and latch pin 4. It is further rigidly fixed by means of attaching stand off arm 16 to the stationary pivot point 7 of the tractor and to pivoting connection 17 of the base, as by means of pins or the like.

The base 1 further has a frame 20 rigidly mounted thereon. The frame 20 has a member 21 adapted to receive a sliding member 22 which is fixed to a holding assembly 23. The holding assembly 23 mounts anvil 24 which is adapted by means of receiving members 25 to abut and engage the upper end 26 of a conventional post 27.

The holding assembly 23 also has pivoting connectors 28 connecting pivot arms 29 to push levers 30 by pivoting connectors 31. The push levers 30 are connected to lever arms 11 of the three point assembly by means of connectors 13, connecting pins 14 and holding pins 15. Pivot arms 29 are equiped with pivot points 32, which pivotly connect with holding arms 33 which pivotly connect with the base 1 by pivot connectors 34. The holding arms 33 and push levers 30 are adjustable so as to adjust the down stroke of the anvil 24 by means of adjustment means 35 and 36.

Figure 3:
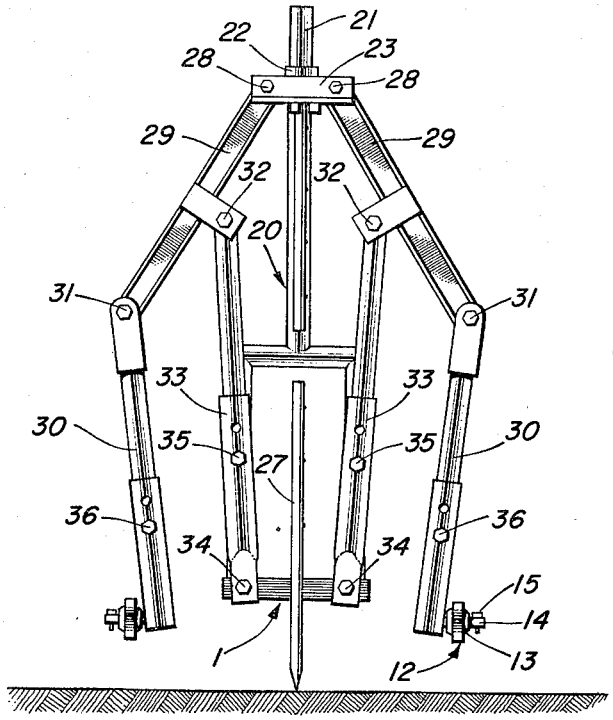
FIG. 3 shows a back view of the apparatus in the ready position.
Figure 4:
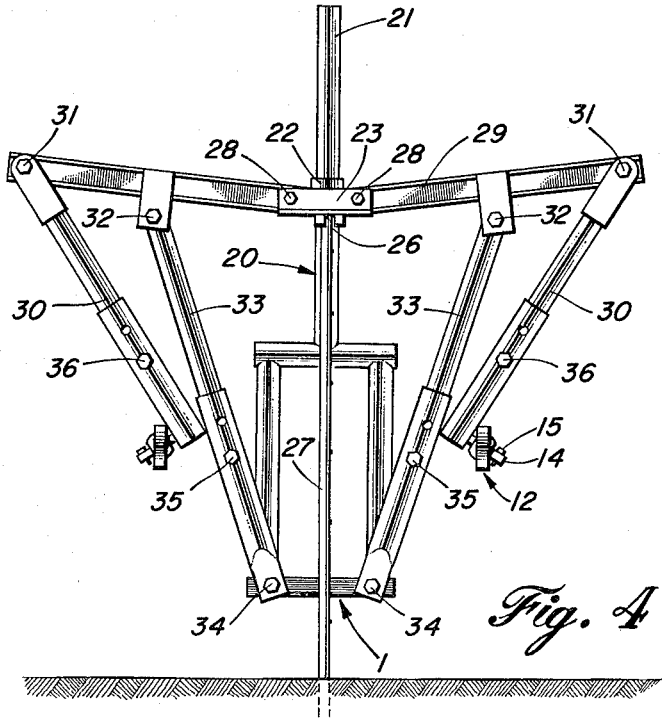
FIG. 4 also a back view of the apparatus in the driving position.

Referring now particularly to FIG. 3 and 4, and the other Figures as appropriate, the driving apparatus is shown in a ready position in FIG. 3 and in the driving position in FIG. 4.

Figure 5:
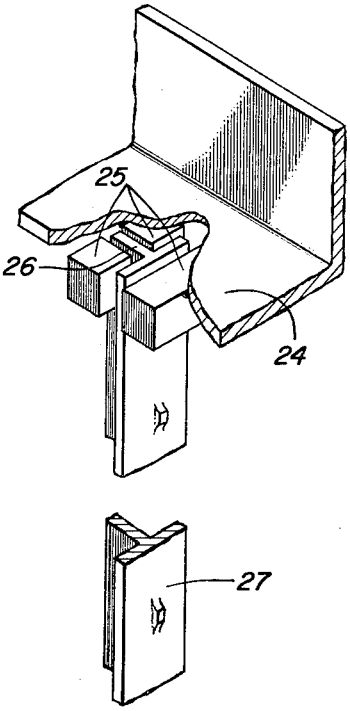
FIG. 5 shows a perspective of the anvil illustrating detail of the embodiment designed for driving conventional T cross section steel fence posts.

A post 27 is positioned at a site where it is desired to be driven with its upper end 26 abutting anvil 24 and within receiving members 24 (as particularly shown in FIG. 5). The apparatus is in the ready position (as shown in FIG. 3).

Thereupon the internal hydraulic system of the tractor is activated. Lifting arms 8 are powered up, and via universal connectors 9, connecting arms 10, and lifting connectors 18, the two point connectors 12 are powered up by pivoting of lever arms 11 against connections 19.

When the two-point connectors 12 are thus powered upward they lift push levers 30 by way of connectors 13. The push levers 30 in turn lift via pivoting connectors 31 causing pivot arms 29 to rotate on pivot points 32, (which pivot points 32 also pivot holding arms 33 rotationally outward about pivot connectors 34) thus urging holding assembly 23 downward via pivoting connectors 28.

The post 27 is thus urged downward into the earth by downward movement of the anvil 24 affixed to the holding assembly 23 as the holding assembly is urged downward along member 21, being held on track by sliding member 22. The apparatus is shown positioned in the driving position by FIG. 4.

Thus, a post, stake, or similar upright is readily driven by the apparatus of the invention utilizing the uppowering of the two point of a conventional three-point system found on virtually all modern farm tractors.

Various other embodiments and modes may suggest themselves to those skilled in the art. For example, the anvil 24 and receiving members 25 on the holding assembly 23 may be readily modified to drive various uprights. Thus, a cup anvil and receiving member combination can be employed for wooden posts or stakes. Or, a ratcheting device as shown in U.S. Pat. No. 2,551,897 can be employed. Latches which grip the sides of an upright are also useful in some applications.

In another aspect, member 20 and sliding member 22, as shown in the embodiment described, may be replaced with a rail and carrier wheels or slides.

The base, of course, can be tailored to fit a particular type of tractor, and the other parts can be fabricated or adjusted accordingly.

I claim:

1. An apparatus for driving an upright which is operable in combination with a tractor equipped with a three point hitch system comprising:

(a) a base rigidly mountable on the rear of the tractor chassis and ridigly braceable to the stationary point of the three point hitch system, (b) rigidly mounted in an upright position on the base, a frame having a vertical member, (c) a holding assembly having an urging means for urging the upright downward and a tracking member for tracking along the vertical member movably mounted on the vertical member, (d) a pivot arm on each side of the holding assembly pivotly connected on one end thereto and on the other end to one end of a push lever, (e) the opposite end of each push lever pivotly connectable to the outer ends of the lift lever arm of the three point hitch system, (f) at a point along the length of each pivot arm a pivot connection connecting one end of a holding arm, and (g) the other end of each holding arm pivotly connected to the base, such that upward movement of the lift lever arms urges the push levers upward, in turn urging the connecting ends of the pivot arms upward, pivoting at the pivot connections of the holding arms, thus urging the other ends of the pivot arms downward along with the holding assembly and urging means along the vertical member, while the holding arm pivot outward on the pivot connections to the base.

2. The apparatus of claim 1 wherein the urging means of the holding assembly comprises an anvil means and receiving means adapted for driving and holding the upper end of a conventional T cross section steel fence post.

3. The apparatus of claim 1 wherein the vertical member of the frame on the base is round in cross section and wherein the tracking member of the holding assembly comprises a slide shaped such as to be slidable vertically along the vertical member.

4. The apparatus of claim 3 where each push lever and each holding arm is adjustable as to length.

5. The apparatus of claim 4 wherein the position of the pivot connection along the length of each pivot arm is adjustable.

6. The apparatus of claim 4 wherein the urging means of the holding assembly comprises an anvil means and a receiving means adapted for driving and holding the upper end of a conventional T cross section steel fence post.

* * * * *